United States Patent [19]

Perrien

[11] 4,393,905

[45] Jul. 19, 1983

[54] WIRE SPLICING TOOL

[76] Inventor: Frank A. Perrien, 205 Calva Rd., North Little Rock, Ark. 72116

[21] Appl. No.: 301,471

[22] Filed: Sep. 14, 1981

[51] Int. Cl.[3] ..... B21F 15/04

[52] U.S. Cl. ..... 140/118

[58] Field of Search ..... 140/117, 118, 120, 123, 140/124, 149, 106, 52, 69; 72/457, 458

[56] References Cited

U.S. PATENT DOCUMENTS 741,177 10/1903 Smith ..... 140/117

*Primary Examiner*—Lowell A. Larson

*Assistant Examiner*—Linda McLaughlin

*Attorney, Agent, or Firm*—Stephen D. Carver

[57] ABSTRACT

A wire splicing tool. The tool comprises an elongated, rigid frame, including a pair of outwardly diverging handle ends. A rigid, integral, tubular frame center receives the shank of a rotatable member for controlling wire splicing. The control member includes an external, wire contacting head which forcibly coils wire ends in response to tool rotation. The control shank includes an elongated, wire receptive groove. When the groove is aligned with a slot defined in frame center, capture (or release) of a first wire segment is facilitated. With the first wire captured, the tool may be rotated to coil an end of a second wire about the first.

7 Claims, 13 Drawing Figures

WIRE SPLICING TOOL

BACKGROUND OF THE INVENTION

The present invention relates generally to wire splicing tools. More particularly, the present invention relates to tools adapted for splicing barbed wire segments. The invention is believed classified in U.S. Class 140.

A variety of prior art devices have long been known for splicing pieces of wire together. Prior art splicing tools differ radically in their approach and application. Several different types of wires exist, including single strand or multi-strand wires. Most of the prior art devices known to me will function adequately for single strand wire. However, various engineering deficiencies inherent in priort art devices are apparent with respect to twin stranded barbed wire commonly found on ranches, farms and the like.

Examples of prior art splicing tools may be seen in U.S. Pat. Nos. 741,177; 755,542; 3,578,035; 1,020,191; 1,969,616; 1,007,535; 3,613,745; 2,031,167; 3,213,899; and, 2,253,983. Most of the latter patents disclose a form of mechanical projection or gripping portion, such as curved edges, holes, or the like, which are adapted to receive and control at least a portion of a wire end to be spliced. The handle allows the user to wrap a wire end about either another wire or about itself to form a coupling. However, prior art devices are generally inadequate for splicing broken barbed wire fence. This is particularly true when twin stranded, tempered steel fence wire is encountered. The major reason for the latter factor is that prior art devices have not provided a reliable wire gripping device associated with the splicing tool which properly captures or retains a first wire end while facilitating simultaneous winding of a second wire end about the first. Where prior art attempts have been made to capture a portion of a wire, the designs employed have resulted in a lack of operator maneuverability. On the other hand, with prior art devices which are easily manipulated by one hand of the operator, structure for capturing a portion of a wire is often inadequate, or entirely absent.

SUMMARY OF THE INVENTION

The present invention comprises a wire splicing tool characterized by a central, wire control structure which forcibly captures one of the two conduits to be spliced together. Preferably the tool comprises an elongated, generally wing shaped frame having a pair of handle ends extending outwardly from a central, tubular center. The wire control structure is secured within the tubular center of the frame, and it may be rotated manually between wire capturing or wire discharging positions.

An elongated slot is formed upon one side of the frame central region. A rotatable control structure shank received within the tubular frame center inludes a longitudinal groove adapted to be aligned in registration with the slot to admit or discharge a wire segment. When the control means is rotated so that the groove is misaligned with the slot, the wire is forcibly retained and captured within the frame. Since the control means is centered with respect to the frame, ease of operator manipulation (i.e. rotation) is preserved.

The control means terminates in an integral head projecting outwardly from the frame center. The head includes a thread-like portion for contacting and rotating a wire end to be spliced, and an integral thread guide means which cooperates to urge the wire forced by the thread means into a formed, neatly coiled orientation about an opposite wire end to which it is to be joined.

The wire control means is preferably manually actuated by an elongated stem which projects generally vertically outwardly from its shank in perpendicular relation to the frame through a travel limiting slot. The travel limiting slot prevents inadvertent rotation of the control means in response to pressure from wire being spliced. Preferably the wire control means is spring biased toward a closed position.

Thus an object of the present invention is to provide a wire splicing device which dependably splices wires together.

Another broad object is to provide a reliable splicing tool for repairing broken barbed wire fences.

A still further object of the present invention is to provide a wire splicing tool which can be easily and safely maneuvered by an operator.

A related object is to provide a wire splicing tool which protectively captures a portion of a wire to be spliced.

Yet another object of the present invention is to provide a wire splicing device of the character described which contacts the wire at its central position. It is a feature of the present invention that since wire contact occurs at the center of the tool, ease of manipulation is facilitated.

Yet another object of the present invention is to provide a wire splicing tool of the character described adapted to make uniform and neatly coiled splices when joining two wires together.

These and other objects and advantages of this invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout to indicate like parts in the various views.

DETAILED DESCRIPTION OF THE DRAWINGS

Figure 1:
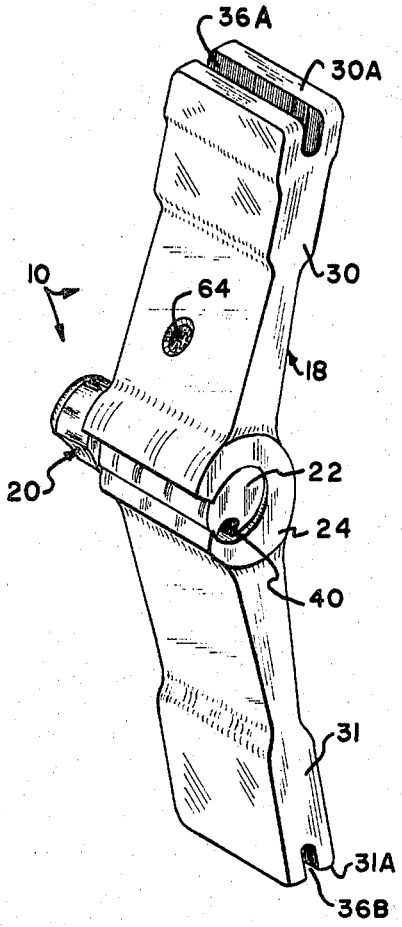
FIG. 1 is an isometric view of a wire splicer constructed in accordance with the teachings of this invention.
Figure 2:
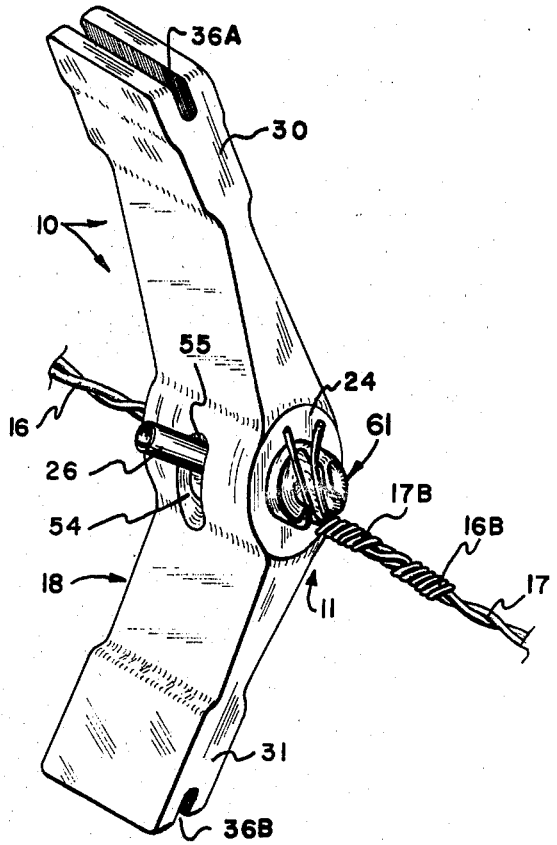
FIG. 2 is an isometric view of the wire splicer taken generally from an opposite side of that illustrated in FIG. 1.

With reference now to the drawings, a wire splicer constructed in accordance with the teachings of the present invention is generally designated by the reference numeral 10. As best viewed in FIGS. 2 and 6, tool 10 is adapted to couple a pair of twisted strand wire ends 16, 17 together.

Tool 10 includes a rigid, elongated frame, generally designated by the reference numeral 18, and a rigid, wire control system, generally designated by the reference numeral 20, which is adapted to control wire ends during splicing. The wire control means 20 comprises an elongated, cylindrical shank 22 rotatably received within the integral tubular center 24 of frame 18. As will be explained in detail hereinafter, a stem 26 is provided for rotating the wire control means 20 to capture (or release) a wire.

Figure 4:
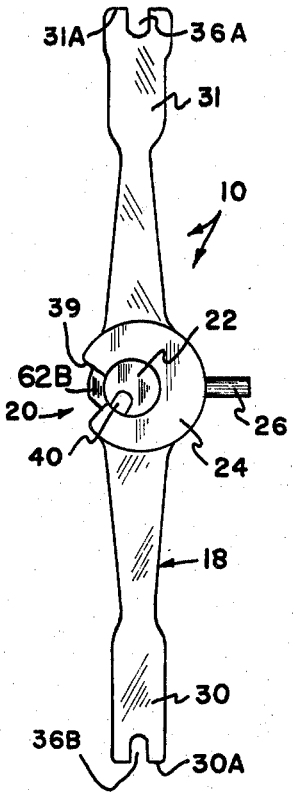
FIG. 4 is a rear plan view of my wire splicer.
Figure 5:
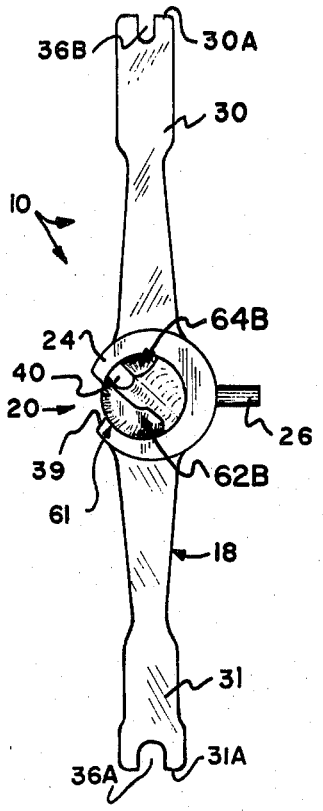
FIG. 5 is a front plan view thereof.

Frame 18 is of rigid, generally elongated metallic construction, including a pair of handles or ends 30, 31 which diverge outwardly and away from the integral, tubular center 24. This wing-like shape facilities manual control. The outermost ends 30A, 31A of handle end portions 30, 31 respectively are provided with optional, elongated channel structure 36A or 36B adapted to aid manipulation of wire ends prior to a splicing operation. Tubular center portion 24 is adapted to receive the shank portion 22 of the wire control means 20. As best noted in FIGS. 3–5, shank 22 includes an elongated groove 40 defined about one side of its length which is adapted to receive or retain an end of a wire to be spliced. As best viewed in FIG. 3, a cooperative, elongated slot 39 is defined about an edge of the center 24 of the frame 18. Thus when groove 40 is aligned with slot 39 a wire may be admitted into (or discharged from) the apparatus.

Figure 6:
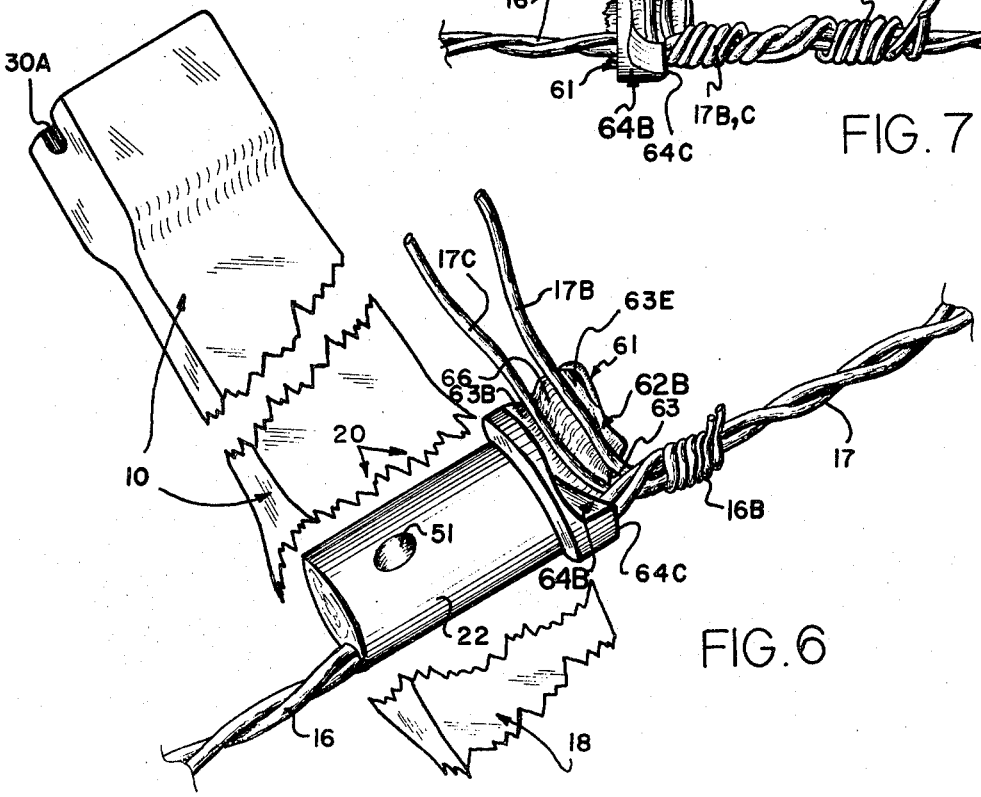
FIG. 6 is an enlarged, isometric view of the tool illustrating the wire control apparatus and wire ends being spliced, with parts thereof broken away or shown in clarity.
Figure 8:
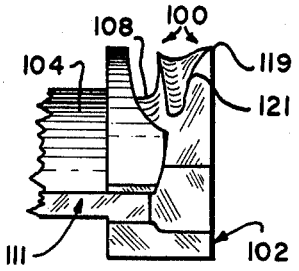
FIG. 8 is an enlarged, fragmentary side view of an alternative head useful for twin strand applications.
Figure 9:
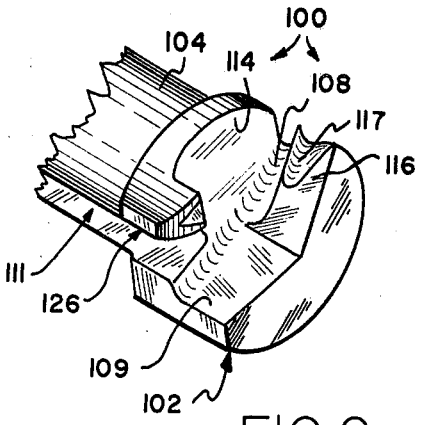
FIG. 9 is an enlarged, fragmentary isometric view of the alternative head.
Figure 10:
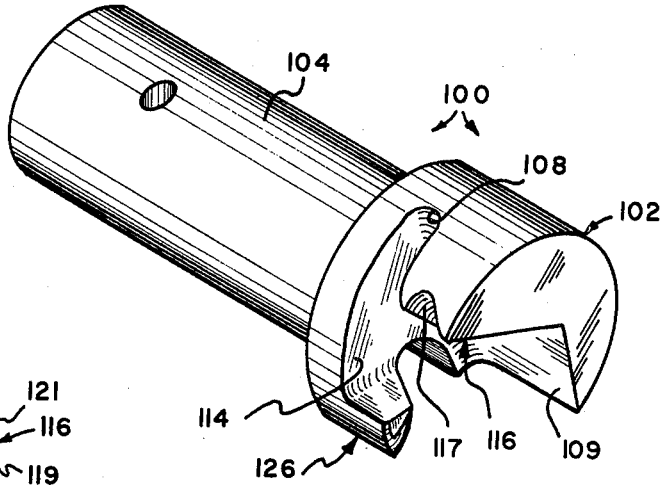
FIG. 10 is an enlarged, fragmentary isometric view similar to FIG. 9, but taken from a alternative vantage point.
Figure 11:
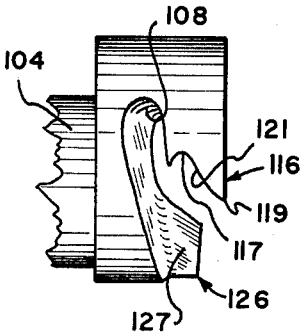
FIG. 11 is an enlarged, fragmentary side view similar to FIG. 8 but illustrating the head rotated 180 degrees.

An elongated, outwardly extending, preferably threaded stem 26 is preferably press fitted to control shank 22, being received within recessed shank orifice 51 (FIG. 6). Stem 26 extends outwardly of the frame 18 through an elongagted travel limiting slot 54 defined in one side of the center, tubular region 24. Thus by moving stem 26 with ones thumb, for example, it may be moved downwardly (as viewed in FIG. 2) within slot 54 to expose groove 40 to slot 39, whereby to permit the capture or release of a wire portion. As best viewed in FIG. 3, the wire control means 20 is biased towards the "closed" position by an elongated spring 60 having one end coupled to stem 26 and its opposite end retained within frame 18. When the frame 18 is diecast, a screw 64 (FIG. 3) may retain the opposite end of spring 60. However when the frame 18 is extruded, a suitable pin may be used instead. Spring 60 is placed within a suitable passageway 62 drilled within frame 18. As will be appreciated from FIG. 3, passageway 62 may be drilled with a suitable drill bit which enters the frame in the drilling operation through the previously defined travel limiting slot 54. Thus stem 26 will normally be biased into limiting contact with an end 55 of travel limiting slot 54. When a wire segment is "captured" between groove 40 and the inner surface of tubular center 24, rotation of the tool 10 with respect to the "captured" wire segment is nevertheless facilitated.

As best viewed in FIGS. 2, and 5–7 the rotatable wire control means 20 preferably includes an integral, wire contacting head, generally designated by the reference numeral 61, which projects outwardly from the front 11 of splicer 10 to forcibly engage a portion of a wire to be twisted. Head 61 preferably includes both a generally arcuate, thread-like portion 62B and a cooperating, spaced-apart, arcuate wire guiding portion 64B. The inner surface of head 61 is preferably of a twin channel design, and it is adapted to contact the end strand(s) of one of a pair of single or multi-stranded lengths to be joined.

Preparation of wire fence ends prior to splicing is facilitated by end channels 36A or 36B. Channel 36A is wider, and it will neatly receive a twin strand section of barbed wire to be spliced. Similarly, narrower end channel 36B will aid in the maneuvering of a single strand segment of wire (or a narrower gauge twin or multi-strand segment, etc.).

Figure 13:
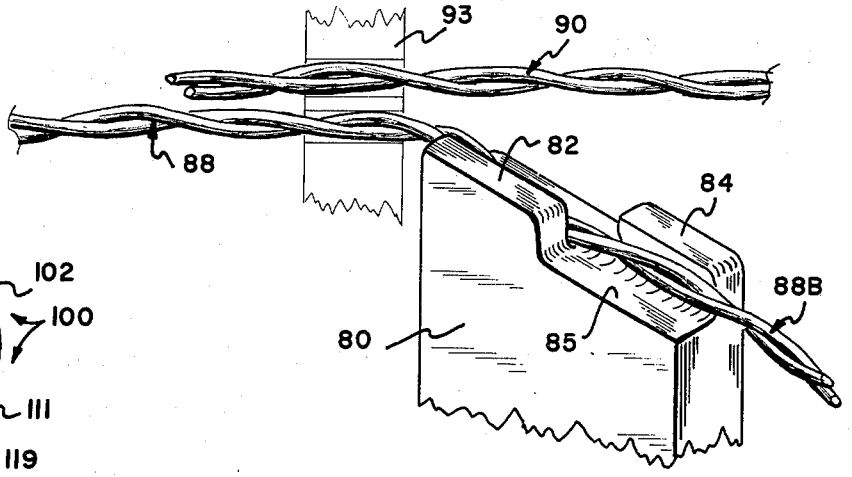

With reference to FIG. 13, an alternative end construction is shown. Segmented tool end 80 terminates in a pair of integral, spaced-apart tabs 82, 84 defined at alternate opposite corners of the channel floor 85. Twin stranded wire segments 88, 90 are to be joined. The wire ends are preferably first trimmed, and then they are clamped together by conventional pliers 93 or similar tool. The end portion 88B of segment 88 is then bent outwardly away from segment 90. A "prying" action is enabled by first placing segment 88B upon floor 85, and then twisting handle 80 to bend the wire prior to coiling.

Thus head portion 61 comprises a "lower" channel 63B (which receives a first wire strand 17C) and a spaced-apart "upper", outer channel 63E (which receives a second wire strand 17B). As best seen in FIG. 6, channels 63B and 63E are separated by arcuate ridge 66 extending generally transversely across the head. Ends 16B of length 16 have been coiled by head 61 about length 17. In FIG. 6 head 61 is shown similarly coiling end(s) 17B, 17C about length 16, a portion of which is retained within control shank 22 (between slot 40 and the walls of frame center 24). As the tool 10 is manually rotated about length 16, contact of stem 26 with end 55 of travel limiting slot 54 prevents relative rotation between control means 20 and frame 18. During this time thread portion 62B turns and wraps the wire ends, which are cradled within channels 63B, 63E, exiting from notch 63 formed in head 61 between guide 64B and thread portion 62. Simultaneously the guide end 64C (FIGS. 6, 7) may abut the outermost region of the coil of the splice being formed. Thus, in response to pressure applied toward the right) as viewed in FIG. 6 or 7) the coiled strands will be forced into tight, neatly coiled abutment.

Figure 12:
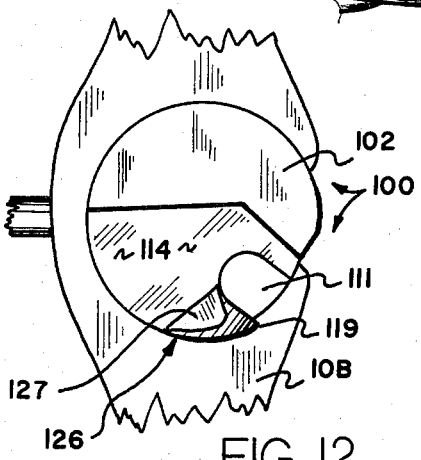
FIG. 12 is an enlarged, fragmentary front plan view of a wire splicing tool constructed in accordance with the teachings of this invention, including the alternative head of FIGS. 8–11; and, FIG. 13 is an enlarged pictorial view of an alternative handle end construction useful for bending wire ends preparatory to splicing, with parts thereof broken away for brevity.

With reference now to FIGS. 8–12, an alternative control means is generally designated by the reference numeral 100. Control 100 includes a special head 102, which is integral with an elongated shank 104. Shank 104 is virtually identical with shank 22, previously discussed. Control shank 104 is similarly rotatably mounted within tool 10B (FIG. 12).

Head 102 includes an arcuate, generally transverse channel 108, which extends across milled floor 109. Longitudinal shank slot 111 (similar to shank slot 40 previously discussed) communicates with channel 108 and divides head wall 114 from projection 116. Projection 116 includes an outer slot 117 which cooperates in operation with channel 108. For example, a dual strand wire segment may be received through and upon floor 109. One strand will seat within channel 108, the companion strand will be guided by and secured within channel 117. As best viewed in FIGS. 8 and 11, channel 117 terminates in upper, outer point 119. The smooth inclined side 121 of this region gradually descends from point 119 to channel 117. It will also be appreciated that channel 108 is lower or deeper than channel 117, so escape of wires held by head 100 will be resisted, as wires will tend to be deflected toward surface 114 during rotation. Guide 126 cooperates with channels 108, 117 to encourage neatly and tightly coiled end splices. Guide 126, which is located upon an opposite side of channel 111 with respect to floor 109 (FIGS. 9, 10), contacts the ends of coiled splices during winding, as described previously in conjunction with discussion of guide 64. Arcuate inner face 127 of guide 126 smoothly merges with head face 114, to urge wire strands into correct position within groove 108 prior to splicing.

Splicer 10 is ideal for use with wires of between 12 and 13.5 gauge. Splicer 10B, which employs wire control 100 and head 102, is ideal for wires of 14 gauge and smaller.

OPERATION

Figure 3:
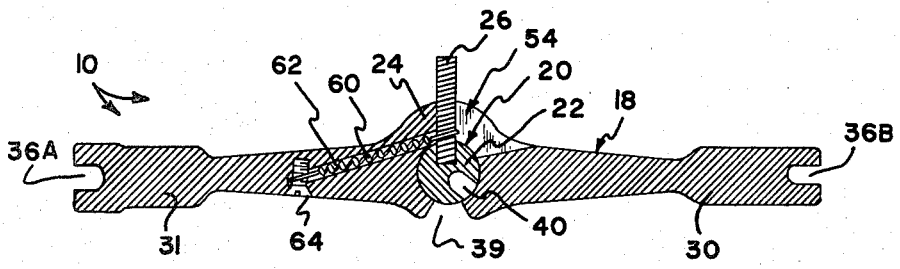
FIG. 3 is a longitudinal sectional view of the wire splicer.
Figure 7:
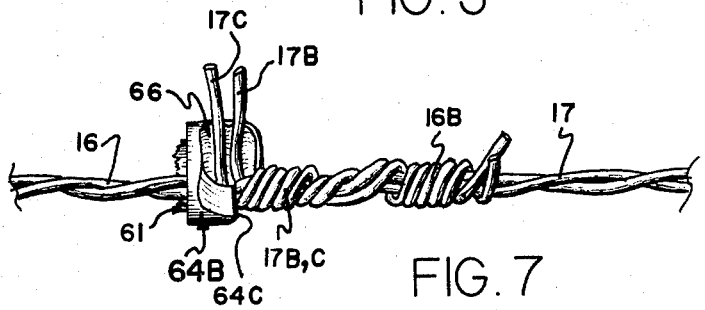
FIG. 7 is an isometric view showing the desired end product of a splicing operation correctly employing the present invention.

A preferred splice formed by either tool 10 or 10B is seen in FIG. 7. If the broken ends of the fence to be mended are long enough, they may be trimmed slightly, preparatory to being spliced. However, as will be appreciated by those skilled in the art, a new section of wire is generally added to the fence and spliced to at least one of the preferably trimmed, broken ends. Afterwards, wire lengths 16 and 17 are held together by a conventional pliers 93 (or other conventional gripping mechanisms), to maintain the two loose, uncoupled lengths in tight contact. Wire ends may be bent with the optional channel construction illustrated in FIG. 13. At this time tool 10 is opened by manually depressing stem 26, against predetermined tension from spring 62, whereupon to align groove 40 with slot 39 (FIG. 3). At this time a portion of length 16 will be captured by control apparatus 20, and release of stem 26 will firmly maintain wire portion 16 within shank 22. The far ends 17B of a portion of wire 17 to be spliced may be moved to the position shown, and subsequent manual rotation of the tool will result in a neatly coiled splice as shown in FIG. 7. Of course the operation must be repeated twice; the ends 16B must be coiled about the portion of wire 17.

It will be understood that the particular multi-strand wire illustrated in FIGS. 6, 7 comprises common, twin strand, barbed wire. However, tool 10 may be employed with a number of differing wire types and forms.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A wire splicing tool comprising:

elongated, rigid frame means adapted to be manually grasped by a user of said tool; the frame means having a generally tubular center portion and a pair of integral, spaced-apart ends extending outwardly from said center portion;

rotatable wire control means associated with said frame center portion for controlling wires to be spliced, said rotatable wire control means comprising:

shank means rotatably received within said frame center for selectively capturing at least a portion of first wire end; and, head means for forcibly contacting and splicing a second wire end about said first wire end in response to rotation of said tool by said user;

manually operated means for rotating said wire control means between a first wire admitting or discharge position and a second wire capturing position, said last mentioned means for manually rotating said wire control means comprising an elongated stem projecting outwardly from said control means shank generally perpendicularly outwardly from said frame within a travel limiting slot which prevents rotation of said wire control means when said tool is rotated to splice wire ends;

said tubular frame center comprising a slot for admitting or discharging a wire segment; and, said shank means comprising an elongated wire receptive groove adapted to be selectively registered in alignment with said slot for admitting or discharging a wire end, and operable when not aligned with said slot to capture a wire segment passing therethrough.

2. The combination as defined in claim 1 wherein said head means comprises a lower channel for cradling a first wire strand and a spaced-apart upper channel for cradling a companion second wire strand whereby to facilitate simultaneous coiling of both stands.

3. The combination as defined in claim 2 including rigid guide means projecting integrally outwardly from said head means in generally transverse relation with respect to said upper and lower channels for forcibly abutting the end of a coil being formed.

4. The combination as defined in claim 1 wherein said tool includes spring means within said frame means for normally biasing said rotatable control means toward a closed wire capturing position.

5. The combination as defined in claim 1 including end channel means defined in at least one of said spaced-apart frame ends for facilitating manipulation of loose wires prior to coiling.

6. The combination as defined in claim 5 wherein at least one of said end channel means is segmented, including a pair of integral, spaced-apart tabs defined at alternate, opposite corners of the end channel.

7. The combination as defined in claim 1 wherein said tool frame ends diverge outwardly from said frame center tubular portion.

* * * * *